US005134898A

United States Patent [19]

Anderson

[11] Patent Number: 5,134,898

[45] Date of Patent: Aug. 4, 1992

[54] ROTARY TACTILE FEEDBACK APPARATUS

[75] Inventor: Eric L. Anderson, Santa Clara, Calif.

[73] Assignee: Hewlett-Packard Company, Palo Alto, Calif.

[21] Appl. No.: 666,171

[22] Filed: Mar. 7, 1991

[51] Int. Cl.[5] ..... G05G 1/08

[52] U.S. Cl. ..... 74/527

[58] Field of Search ..... 74/527, 10.41

[56] References Cited

U.S. PATENT DOCUMENTS

| | | | |
|---|---|---|---|
| 2,840,672 | 6/1958 | Martin | 74/527 |
| 3,059,497 | 10/1962 | Eadie | 74/527 |
| 3,096,665 | 7/1963 | Cappelle et al. | 74/527 |
| 3,560,672 | 2/1971 | Ludlum et al. | 74/527 X |
| 4,071,720 | 1/1978 | Krajci et al. | 74/527 X |
| 4,920,818 | 5/1990 | Nagano | 74/527 X |

OTHER PUBLICATIONS

Product brochure—"Bourns Slimline Potentiometers".
Product brochure—"Noble Rotary Encoded Switch Series SDB161".
Product brochure—"Optically Coupled Rotary Encoder Switch".
Product brochure—"Standard Grigsby—We Switch The World".
Article entitled "Long Lived Devices Offer High Resolution", by Doug Conner, *Electronics Design News* Magazine (EDN), Apr. 26, 1990.

*Primary Examiner*—Leslie A. Braun
*Assistant Examiner*—Ryan W. Massey

[57] ABSTRACT

A tactile feedback apparatus, such as for a rotary opto-electronic motion encoder switch, has a ball that successively engages indentations in the surface of a hub. The ball is biased against the hub in a direction at an angle to the perpendicular to the surface by an angled leaf spring. The indentations in the hub are sufficiently deep so that the ball does not contact the floor of any indentation. As the hub wears, the spring inwardly biases the ball to contact the hub at a progressively decreasing radius. Consequently, the useful life of the apparatus is extended, and performance does not significantly degrade during the useful life.

20 Claims, 6 Drawing Sheets

ROTARY TACTILE FEEDBACK APPARATUS

TECHNICAL FIELD

This invention relates to tactile feedback apparatuses and more particularly relates to apparatuses for providing a stepped resistance to movement, such as are used in rotary switches or optoelectronic encoders.

BACKGROUND AND SUMMARY

Detent devices are used to provide tactile feedback to users of rotary switches. These enable a user to determine whether and how far a switch has been turned. In addition, such devices prevent inadvertent rotation of a switch by requiring a threshold amount of torque to overcome the resistance of the device. This torque requirement also reduces the risk that a switch will change positions due to shocks or vibrations in a hostile environment. Known devices typically use a stylus that is perpendicularly biased against a detented surface.

In addition, detent devices are used to select discrete switch positions and to prevent continuously variable intermediate positioning. Detent positions are typically consistent and repeatable.

A major problem in prior art devices is that wear of the detented surface reduces the useful life, and degrades the tactile feel performance throughout the product life. Reduced internal spring forces will permit marginally increased lifespan, but at the cost of degrading initial tactile feel. There is generally a desire in the market for improved tactile feel.

Known devices typically use a spring biased stylus, such as a pair of balls, that is pressed against a moving surface formed with alternating hills and valleys. The stylus sweeps out a constant circular path, wearing down the hills at a much more rapid rate than that of the slow-wearing valleys. Consequently, the torque required to rotate the device is progressively reduced, and tactile feel is degraded.

One such device is a SDB161 "Slimline" potentiometer manufactured by Noble, Inc. It employs a metal leaf spring having a protruding dimple that follows hills and valleys molded on a plastic rotary hub. The hills wear down to the level of valleys as the dimple abrades the hub. Wearout typically occurs at about 300,000 revolutions.

A second type of device is a "Series 61" device manufactured by Grayhill, Inc., and is illustrated schematically in FIG. 1. The SG-OE1-16 device manufactured by Standard Grigsby, Inc. is comparable. These devices each comprise a pair of oppositely biased balls that follow an interior circumferential surface formed with inwardly convex circular bumps that function as hills.

Twin ball devices such as the FIG. 1 device have the disadvantage that any misalignment that leaves one ball fully detented in a valley while the other is not causes the balls to fight each other, reducing the stability of the detented position and consequently preventing a crisp feel. In addition, the bumps of the FIG. 1 device wear down continually throughout the life of the device, progressively degrading tactile performance. Such a device typically lasts about 1,000,000 revolutions.

FIG. 2 shows a third type of detent device. The Hewlett-Packard Company HP 17501A channel indicator includes a switch using a twin ball design in an application where an extended life span is not required.

The FIG. 2 device presses the balls perpendicularly against a perforated plate.

A central feature of the preferred form of the present invention is that a detent ball is biased by a spring at a non-perpendicular angle to a detented hub surface. Therefore, as the hub wears, the ball gradually progresses radially inward to encounter new surface material.

A second feature provides that the indentations are sufficiently deep so that the ball does not touch the bottom of the indentations. This permits the device to retain a crisp feel throughout a long product life.

A third feature of the preferred form of the invention is that it uses only a single ball as a stylus, thereby avoiding the disadvantages of twin ball devices.

A fourth feature of the preferred form of the invention is that the ball freely rolls over the detent hub, and does not slide over the surface. This eliminates wear caused by abrasion.

Increased use of the preferred embodiment does not degrade device torque or tactile feel. In fact, these properties have actually been found to improve slightly over time in the preferred form of the invention because the rate of wear of the hub surface (functioning as hills between the indentations) is equalled or exceeded by the wear rate of the indentations. The indentations wear faster because the ball is wedged progressively deeper into each indentation over time, but does not hit bottom. This wedging process microscopically deforms the rim of an indentation, forcing the rim outward and upward to buttress the adjacent hub surface, thereby counteracting the effect of wear.

The amount of work the ball must perform on the spring as the device is switched to the adjacent detent is determined by the amount of vertical travel by the ball between the detented position (ball in an indentation) and the non-detented position (ball on the hub surface between indentations). Therefore, the torque and tactile feel are substantially undegraded because the vertical travel distance is maintained or increased as the device wears. The device wears out when ball path is sufficiently worn so that the spring crashes into the hub surface.

As a result of these and other features, the present invention provides a rotary tactile feedback device which does not degrade over its life, and which has a typical lifespan of 3,000,000 revolutions, a factor of ten improvement over comparable existing devices.

The foregoing and additional features and advantages of the present invention will be more readily apparent from the following detailed description, which proceeds with reference to the accompanying drawings.

DETAILED DESCRIPTION OF A PREFERRED EMBODIMENT

Figure 1:
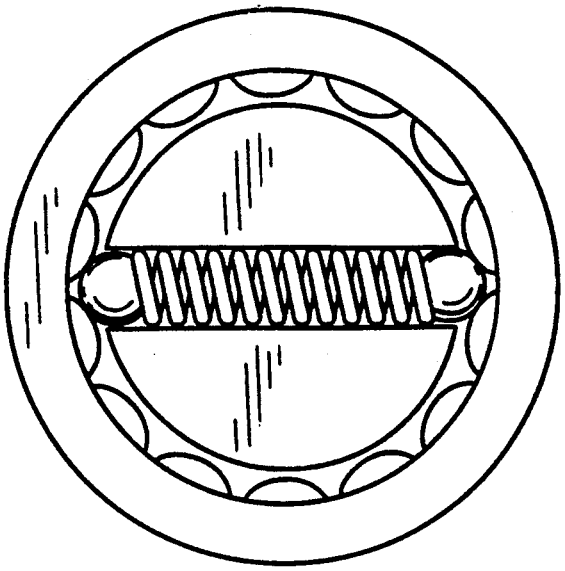
FIG. 1 Prior Art
FIG. 1 is a schematic sectional plan view of a first prior art apparatus.
Figure 2:
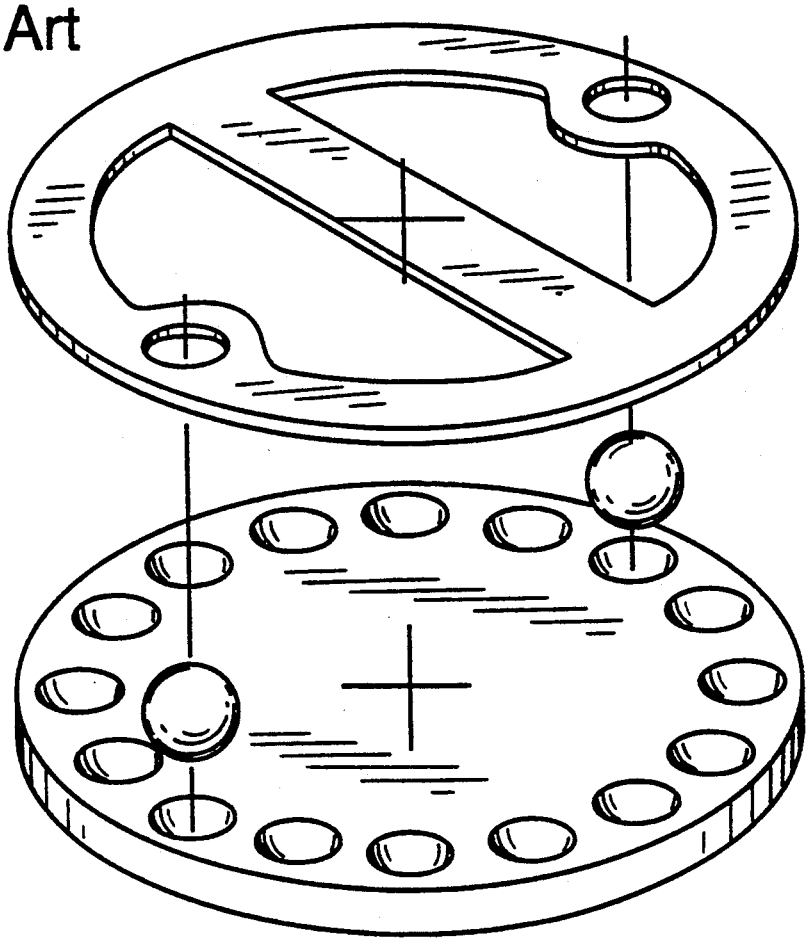
FIG. 2 Prior Art
FIG. 2 is an exploded perspective view of a second prior art apparatus.
Figure 3:
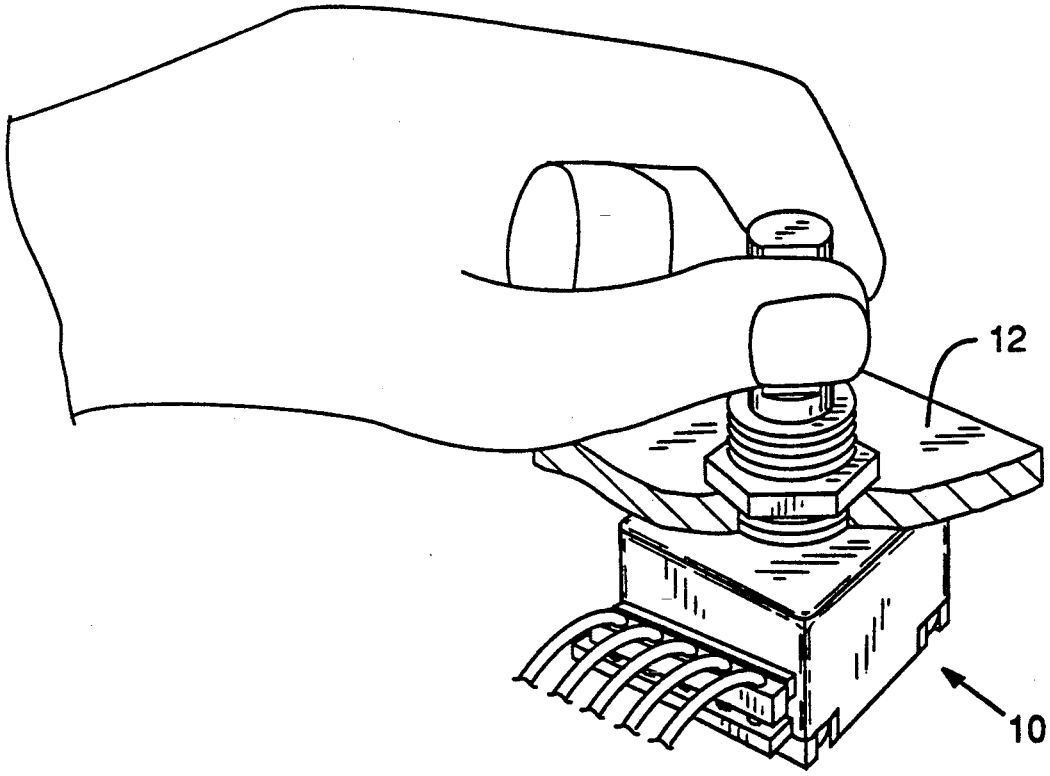
FIG. 3 is a perspective view of an apparatus according to the present invention in a standard panel installation.

FIG. 3 shows a preferred embodiment of the present invention as a detent apparatus used in an optoelectronic digital rotary switch 10. The switch 10 is installed in a panel 12 so that the switch 10 may be manually operated.

Figure 4:
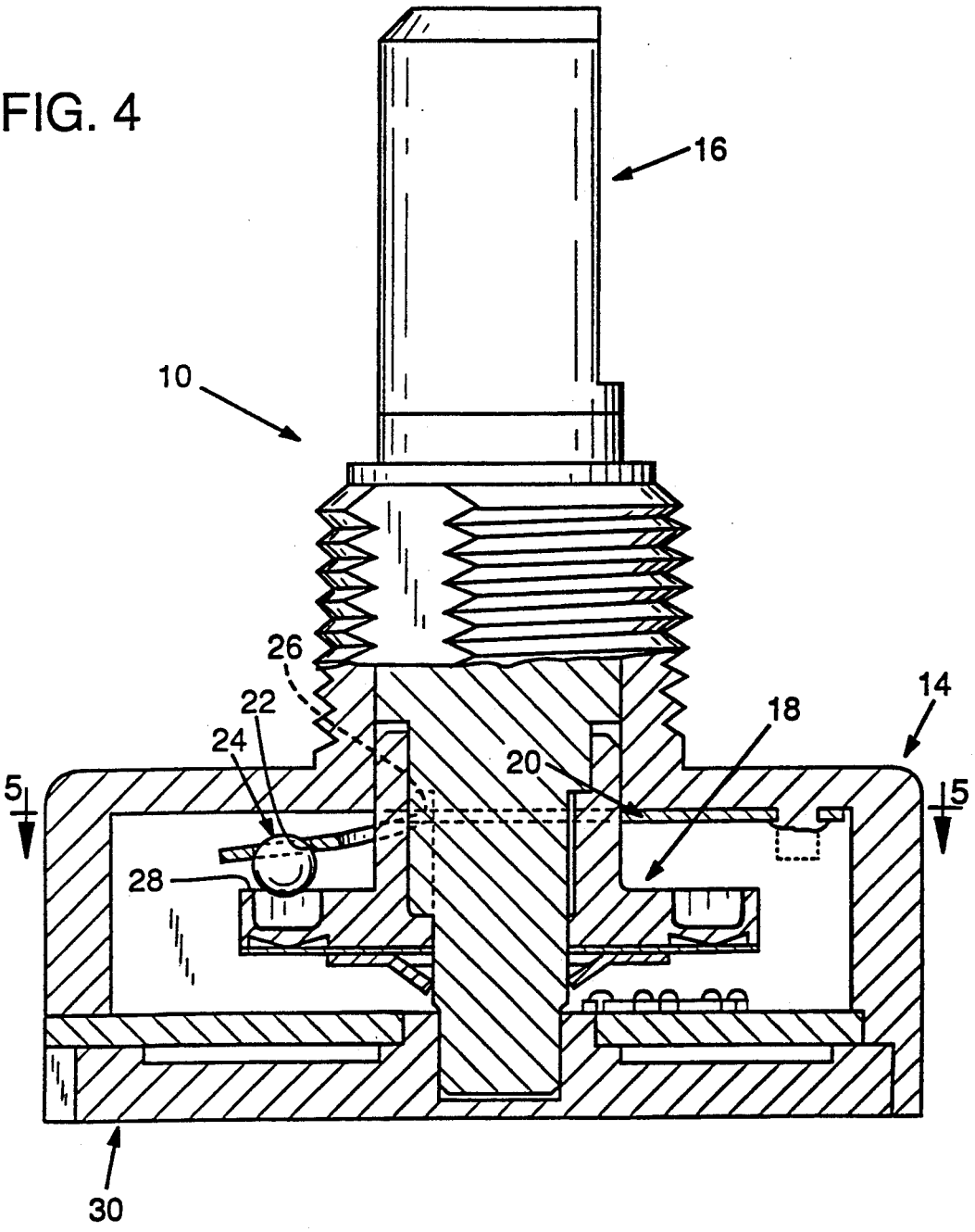
FIG. 4 is a sectional diagonal side view of the apparatus of FIG. 3.

FIG. 4 generally shows that the illustrated embodiment of the present invention is a switch 10 having a housing 14 with a rotatable shaft 16 received therein. A hub 18 is engaged by the shaft 16 and rotated within the housing 14. A leaf spring 20 is attached to the housing 14 and defines a ball engaging hole 22 that receives a metal ball 24. The spring 20 is provided with a downward bend 26 to bias the ball 24 against an upper surface 28 of the detent hub 18. A housing cover 30 rotatably receives the shaft 16 and is fixed to the housing 14.

Figure 5:
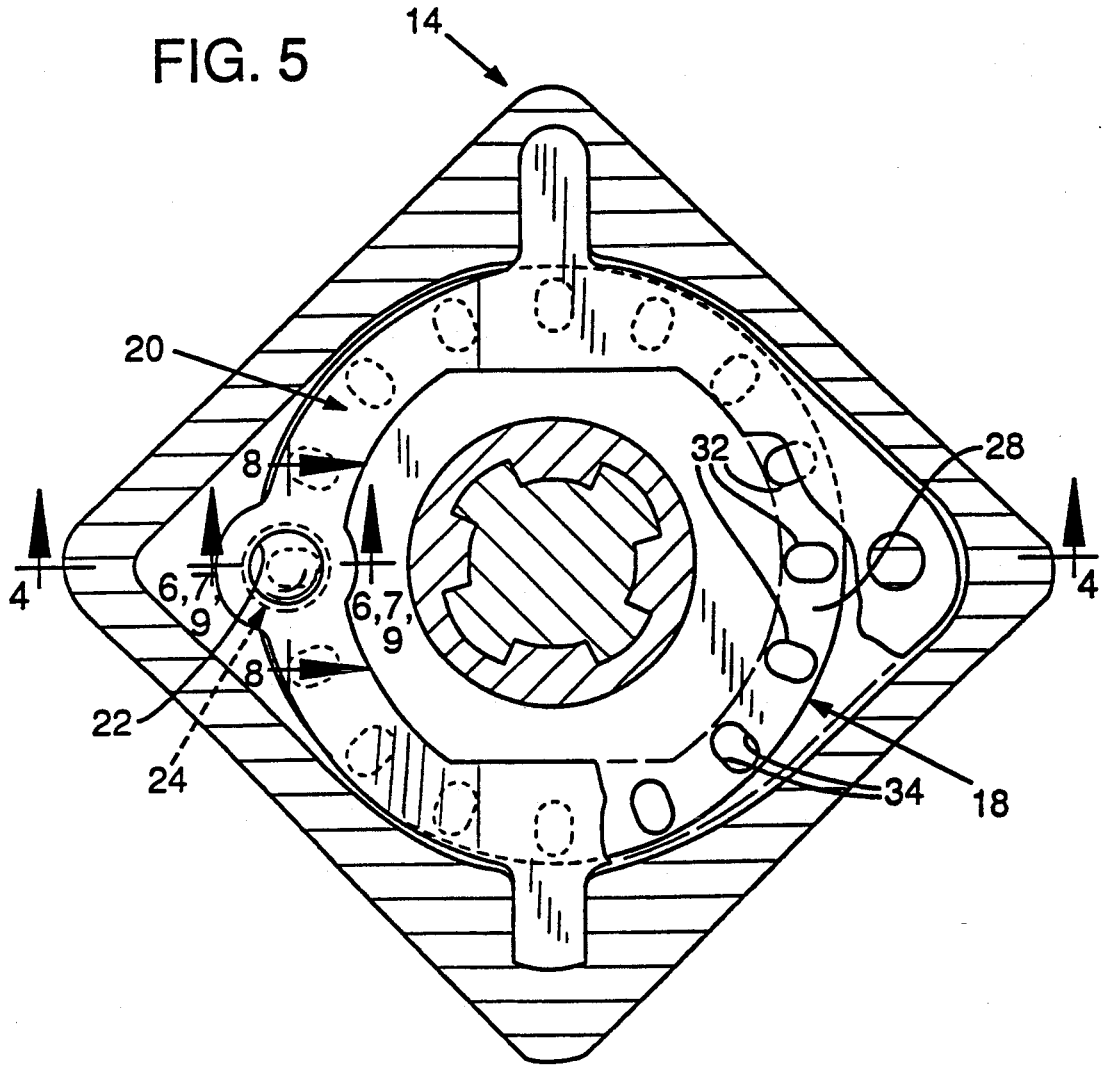
FIG. 5 is a sectional plan view of the apparatus of FIG. 4, taken along line 5—5 with the apparatus in a detented position.

FIG. 5 shows a plan view of the hub 18 received within the housing 14. An array of indentations 32 are defined in the upper surface 28 of the hub 18. The indentations 32 are preferably evenly spaced in a circular arrangement to align with the ball 24. The indentations 32 are located near the edge of the hub 18. Each indentation 32 is an oblong having a pair of flat, side walls 34 and is oriented generally radially on the hub where generally radial is defined as the side walls 34 not being along the ball path.

Figure 6:
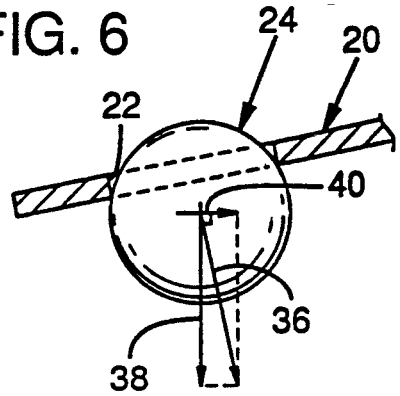
FIG. 6 is an enlarged sectional side view of the spring and ball of the apparatus of FIG. 5 taken along line 6—6.

FIG. 6 shows the forces acting on the ball 24 by the spring 20. A net force vector 36 is perpendicular to the plane of the spring 20 at the ball engaging hole 22. The net force vector 36 is the summed result of a downwardly directed vertical component vector 38 and a radially inwardly directed horizontal component vector 40. Consequently, the ball 24 is biased downwardly and inwardly.

Figure 7:
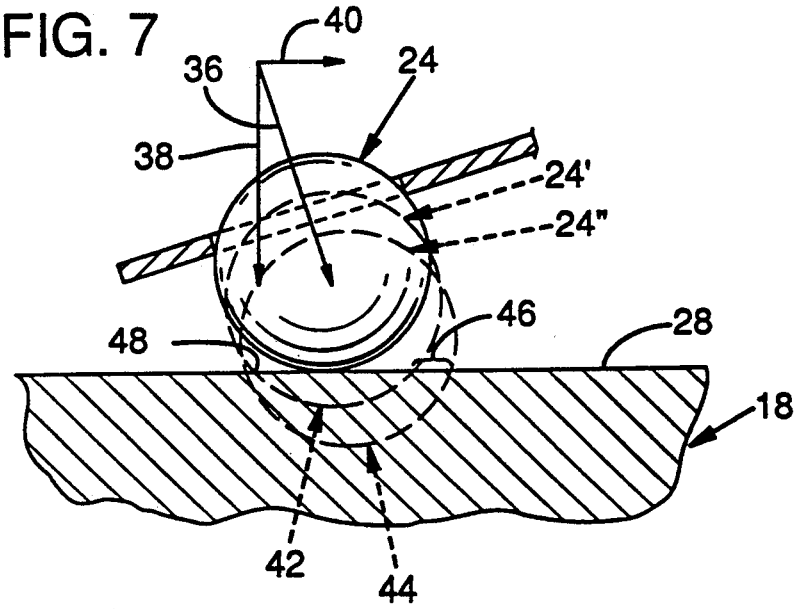
FIG. 7 is an enlarged sectional plan view of the apparatus of FIG. 5 taken along line 7—7 with the apparatus in a non-detented position.

FIG. 7 shows how the inwardly biased ball 24 wears a deepening and radially shifting groove 42, 44 in the upper surface 28 of the hub 18 between indentations 32 (not shown). When such wear occurs in a prior art device using perpendicularly biased balls, the torque performance degrades as the balls wear down the same worn path. In the illustrated embodiment of the present invention the ball 24 continually shifts radially inward toward the center of the hub 18 as wear occurs, encountering a small amount of the fresh hub surface 28.

The effect of this inward advancing of the ball 24 is that a high torque, crisp tactile feel of the device is maintained, even after substantial wear has occurred.

Because the ball 24 follows the net force vector 36, the ball 24 progressively moves downwardly (in the direction of the downward vector 38) and inwardly (in the direction of the inward vector 40) into a partially recessed ball position 24' and subsequently into an additionally recessed ball position 24''. As wear occurs, the ball 24 continues to encounter unworn portions of the hub surface 28 in the inward direction 40 from the ball 24. For example, as the ball 24 moves from the partially recessed position 24' to the additionally recessed position 24'', an inward surface portion 46 is encountered and worn away by the ball 24, while the outer groove edge 48 is essentially unchanged.

Figure 8A:
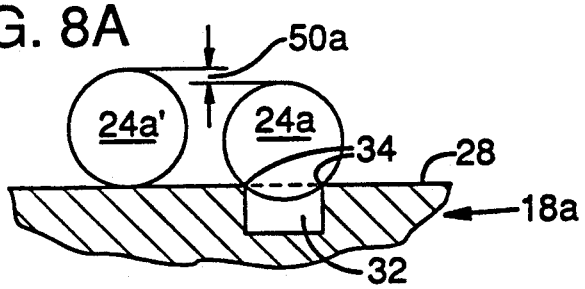
FIG. 8*a* is an enlarged sectional side view of the apparatus of FIG. 5 in a new condition taken along line 8—8.
Figure 8B:
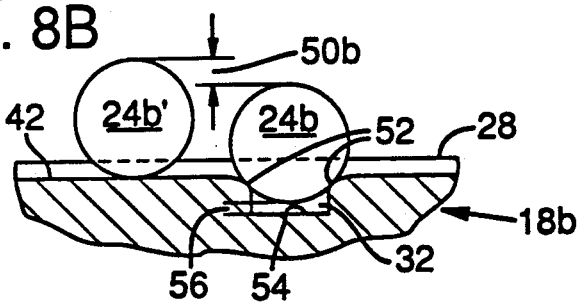
FIG. 8*b* is an enlarged sectional side view of the apparatus of FIG. 5 in a worn condition taken along line 8—8.

FIGS. 8*a* and 8*b* show the device before and after wear has occurred, and illustrate how torque performance improves over time. A primary factor affecting the torque needed to switch from one detent to the next is the vertical distance the ball must move against the force of the spring as the ball moves from a lowest detented position to a highest nondetented position. This factor is independent of the angle between the net force vector 36 and the hub surface 28, as discussed above with respect to FIGS. 6 and 7. FIGS. 8*a* and 8*b* each show only a single indentation 32 for clarity.

FIG. 8*a* shows the unworn hub 18*a* with the detented ball 24*a* and the nondetented ball 24*a'* separated by a first vertical displacement 50*a*. The detented ball 24*a* rests in the indentation 32, and is in contact with opposed side walls 34; the nondetented ball 24*a'* contacts the hub surface 28.

FIG. 8*b* shows the worn hub 18*b* with the detented ball 24*b* and the nondetented ball 24*b'* separated by a second vertical displacement 50*b*. The detented ball 24*b* rests in the indentation 32 and contacts a pair of opposed rounded contact points 52; the nondetented ball 24*b'* rests in the deepening groove 42'. Each indentation has a floor 54 spaced below the hub surface 28 by a sufficient distance, preferably at least one half the ball diameter, so that the ball 24*b* is separated from the floor 54 by a floor gap 56 when the device is in a worn condition as shown in FIG. 8*b*.

The second vertical ball displacement 50*b* of the worn device of FIG. 8*b* is greater than the first vertical ball displacement 50*a* of the new device of FIG. 8*a*. This requires that more work be done against the spring 20 (not shown) in the worn device than in the new device, resulting in improved torque performance in the worn device. The opposed side walls 34 of each indentation 32 are sharp edges that wear more rapidly than the flat surface 28. The edges of the side walls 34 become rounded contact points 52, allowing the ball 24*b* to rest more deeply in the indentation 32. As a result of this wear, the ball 24*b* works progressively deeper into the indentations 32 faster than it wears into the flat hub surface 28 between indentations 32.

Figure 9:
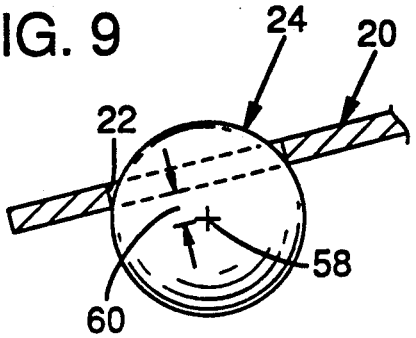
FIG. 9 is an enlarged sectional side view of the spring and ball of the apparatus of FIG. 5 taken along line 9—9.

FIG. 9 shows the relationship between the ball 24 and the ball engaging hole 22 of the spring 20. To substantially reduce wear, the ball 24 must rotate within the ball engaging hole 22 as the ball 24 rolls over the upper surface 28 of the hub 18 (not shown). If the ball 24 binds in the ball engaging hole 22, the ball simply scrapes over the hub 18 and accelerates the wear rate by about a factor of ten. To avoid binding, the diameter of the ball 24 should preferably be between 1.04 and 1.16 times the diameter of the ball engaging hole 22. If the ball engaging hole 22 is too large, the ball 24 will tightly wedge in the hole 22, or entirely pass through.

A too small ball engaging hole 22 will also bind the ball 24. The ball 24 has a ball center 58 that is offset from the spring by an offset distance 60. If the offset distance 60 is excessive, the spring 20 will act on the ball 24 with an eccentric force. Consequently, the ball 24 will bind with the ball engaging hole 22 or entirely rotate out of the hole 22 as the hub 18 rotates. To minimize wear, the hub 18 is formed of a high durability molded thermoplastic such as the liquid crystal polymer Vectra A625, available from Hoechst Celanese Corporation. In addition, a small amount of synthetic grease between the ball 24 and the ball engaging hole 22 will marginally reduce the rate of wear.

Figure 10:
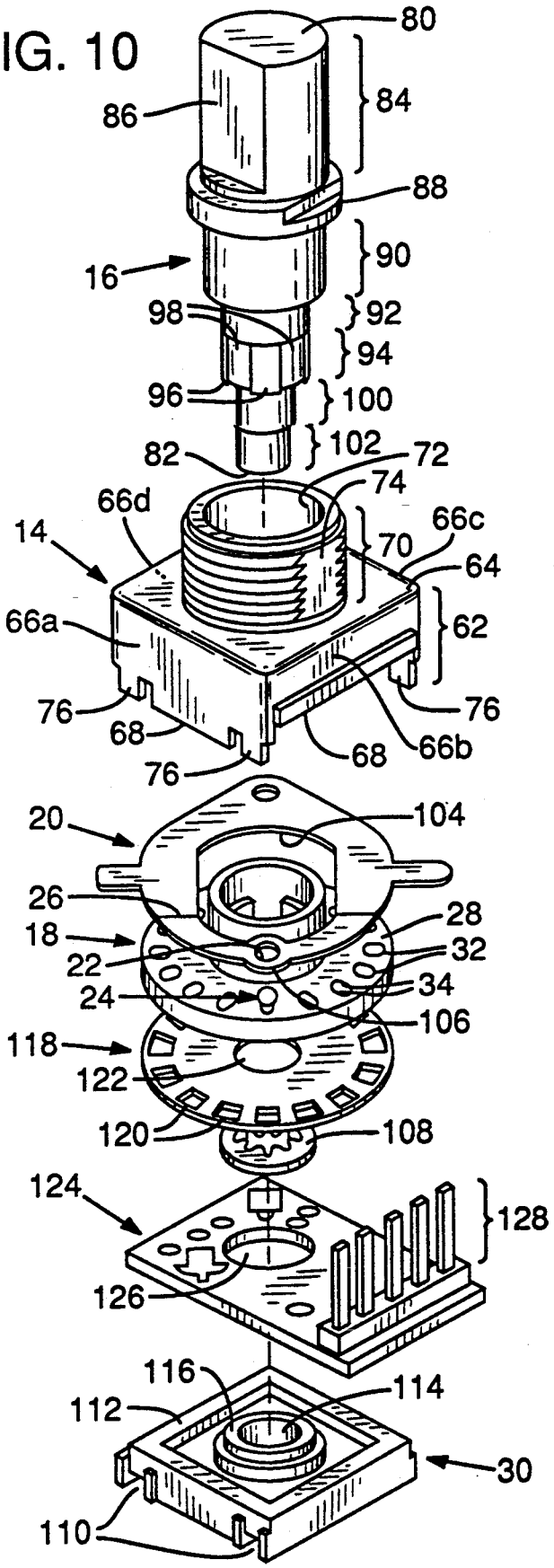
FIG. 10 is an exploded isometric view of the apparatus of FIG. 3.

FIG. 10 shows that the housing 14 has a square, box-shaped body 62 having a square upper panel 64 and four side skirt panels 66*a*–66*d* depending downwardly therefrom, forming a box that is open in a downward direction. Each panel 66*a*–66*d* terminates at a lower edge 68. The housing 14 has a collar portion 70, which is a circular cylinder axially centered on the square upper panel 64 and which extends upwardly and perpendicularly therefrom. The collar portion 70 defines a cylindrical bore 72. The exterior of the collar portion 70 is provided with helical screw threads and has a pair of opposed flat side surfaces 74 that are parallel to each other and to the axis of the collar portion 70, permitting the switch 10 to be mounted in a standard oblong hole in the panel 12 (not shown) and to be secured by a standard threaded nut.

Each of the opposed and parallel side skirt panels 66*a* and 66*c* has a pair of downwardly depending inwardly bendable retaining tabs 76. Each retaining tab 76 forms a remote portion of the lower edge 68 of each side skirt panel 66*a*, 66*c*, with each pair of tabs 76 being opposed on each edge 68. The housing 14 is preferably formed of die-cast zinc.

As further shown in FIG. 10, the rotatable shaft 16 is an elongated molded plastic part comprising several integral end-to-end stacked coaxial cylindrical sections. The shaft 16 is generally mounted within the bore 72 of the housing 14 with the shaft 16 having an upper end 80 that extends upwardly from the housing 14 and a lower end 82 that extends downwardly into the housing 14 and is contained therein.

A knob engaging portion 84 forms the uppermost portion of the shaft 16. The knob engaging portion 84 is generally circular in cross section and has a flat side panel 86 to permit engagement by a standard knob that typically employs a set screw (not shown).

A flange portion 88 of the shaft 16 is formed immediately below the knob engaging portion 84. The flange portion 88 has a diameter slightly less than the width of the exterior of the collar portion 70 across the opposed side surfaces 74, whereby the flange portion 88 will fit through any panel hole into which the collar portion 70 may be inserted. The flange portion 88 has a diameter slightly greater than the knob engaging portion 84 and has a length substantially shorter than its own diameter.

A bore engaging portion 90 of the shaft 16 is formed immediately below the flange portion 88 and has a diameter sized to be closely received within the bore 72 of the housing 14. Immediately below the bore engaging portion 90 is a hub alignment portion 92 having a diameter less than that of the bore engaging portion 90.

Immediately below the hub alignment portion 92 of the shaft 16 is a hub engaging portion 94. The hub engaging portion 94 has a plurality of longitudinal splines 96 circumferentially arranged in alternation with a similar plurality of recessed regions 98. The splines 96 and recessed regions 98 each preferably number four. The splines 96 have exterior surfaces that form cylindrical segments of the same cylindrical diameter as the hub alignment portion 92. The recessed regions 98 form cylindrical segments of a smaller cylindrical diameter than the splines 96.

Attached immediately below the hub engaging portion 94 of the shaft 16 is an elongated lock washer engaging portion 100 having a diameter less than or equal to that of the recessed regions 98 of the hub engaging portion 94. Attached immediately below the lock washer engaging portion 100 is an elongated cover engaging portion 102 having a diameter less than that of the lock washer engaging portion 100.

As further shown in FIG. 10, the spring 20 is a flat metal leaf spring formed from spring sheet metal, preferably ½ hard beryllium copper. Alternative materials such as stainless steel may be used, but the spring 20 must retain its shape under constant flexing, and the material must not break during the preferred manufacturing process of stamping and forming. In the illustrated embodiment, the spring 20 may be between 0.005 and 0.020 inches thick, with a thickness of 0.008 inch being preferred. The spring 20 is generally ring-shaped in the illustrated embodiment, with four various protrusions therefrom corresponding to the four corners of the housing body 62. A spring aperture 104 is defined in the center of the spring, the aperture having an oblong shape which is generally circular and which gives the illustrated spring a roughly annular body.

The spring 20 is formed with a bend 26 of approximately thirty degrees. The angle of the bend 26 is the primary factor that determines the torque required to turn the switch. The angle may be increased to provide a stiffer feel, or decreased for a gentler feel. The inventor has found that the bend 26 may range between 10 and 45 degrees. Below 10 degrees, there is insufficient biasing force; above 45 degrees, the spring 20 interferes with the hub 18 during assembly.

The ball engaging hole 22 is defined in the annular body of the spring and is centered in an enlarged portion 106 having a generally circular shape concentric with the ball engaging hole so that spring material surrounds the hole on all sides.

As further shown in FIG. 10, the ball 24 is received in the ball engaging hole 22 on the side of the spring 20 facing downward. The ball is preferably a polished steel sphere with a diameter of 1/16 inch. The ball may be adhered to the ball engaging hole with a small quantity of synthetic grease to retain it in place during assembly of the apparatus.

FIG. 10 also shows the detent hub 18 generally in the shape of a circular disk having upper surface 28. The hub 18 is configured to closely engage the splines 96 and recesses 98 of the hub engaging portion 94 of the rotatable shaft 16 so that the hub 18 and shaft 16 are rotatably linked when the hub 18 is installed on the shaft 16.

The indentations 32 defined in the upper surface 28 of the hub 18 have opposed side walls 34 that are spaced apart preferably by about one half the diameter of the ball 24. In the illustrated embodiment, the inventor has found that if the side walls 34 are separated by less than 0.42 times the ball diameter, the tactile feel and torque will be reduced. Also, if the side walls are separated by more than 0.55 times the ball diameter, the ball 24 will rest too deeply in the in the indentation 32, and will tend to grab the indentation 32 or bind in the ball engaging hole 22 of the spring 20. The spring binding problem is also worsened when the ball engaging hole 22 of the spring 20 has a small diameter. Preferred embodiments of the invention include 16 or 32 indentations 32 to optimally exploit the digital output of the illustrated device, but any odd or even number may be used.

As further shown in FIG. 10, a standard lock washer 108 is provided to secure the hub 18 onto the shaft 16. The lock washer is sized and shaped to be installed on the lock washer engaging portion 100 of the shaft 16 and installed against the hub 18, thereby preventing the hub 18 from being removed from the shaft 16.

The housing cover 30, shown in FIG. 10, is molded of thermoplastic and configured to enclose the body 62 of the housing 14 by attaching it to the side skirt panels **66*a*–66*d* at their lower edges 68. The cover 30 is provided with a plurality of tab engaging slots 110 corresponding to the bendable tabs 76. When the cover is installed, the tabs 76 are inwardly bent to prevent removal of the cover 30. The cover 30 has a first side 112 upwardly facing the housing 14 with a shaft receiving recess 114 defined in a raised portion 116. The recess 114 is positioned to align with the lower end 82 of the rotatable shaft 16 and has a diameter sized to closely receive the cover engaging portion 102 of the shaft 16. The recess 114 has a sufficient depth to provide clearance between the lower end 82 of the shaft 16 and the bottom of the recess 114**.

In a preferred embodiment, the detent device is used in conjunction with an optoelectronic digital pulse generator. This embodiment employs a code wheel 118, shown in FIG. 10, which comprises a circular sheet of thin, opaque and reflective material. The code wheel has a peripheral circular array of alternating open and closed radial sectors 120 corresponding to indentations 32 on the hub 18. Alternatively, the code wheel may employ a spiral series of spaces at incrementally varying radial positions (not shown). The code wheel has a central shaft aperture 122 to receive the shaft 16, and is installed between the hub 18 and the lock washer 108.

A printed circuit board 124 is provided to reside in the housing 14 adjacent to the first side 112 of the housing cover 30. The board 124 defines a generally central clearance hole 126 sized to receive the raised portion 116 of the cover and to permit passage and free rotation of the shaft 16. The board includes a connector 128 to provide an electronic connection to external circuits.

An optoelectronic emitter-detector pair (not shown) is attached to the board at a position opposite the hub 18 and corresponding to the sectors 120 of the code wheel 118. Basically speaking, the emitter illuminates the code wheel and the detector determines whether a reflective closed code wheel sector is directly opposite, or if an open code wheel sector is directly opposite. Integrated circuitry is included in a chip mounted to the board 124 to analyze this information and to convert it to a useful digital signal that is communicated via the connector 128.

The inventor has achieved a product life of up to 4,000,000 revolutions in a preferred embodiment having dimensions as discussed above and as follows:

The ring-shaped body of the spring 20 has a diameter of 0.526 inches. The width of the ring-shaped body is about 0.065 inches. The diameter of the ball engaging hole 22 is 0.058 inches. The diameter of the enlarged portion 106 is 0.114 inches. The diameter of the spring aperture 104 is 0.384 inches. The bend 26 is offset from the center of the spring 20 by about 0.060 inches.

In a preferred embodiment, the hub 18 has a diameter of 0.524 inches, and a thickness at its edge of 0.065 inches. The outer ends of the indentations 32 are at a 0.235 inch radius from the axis of the hub 18. Each indentation 32 is 0.040 inches deep, 0.040 inches long, and 0.030 inches wide. In the embodiment having 32 indentations 32, the indentations are spaced apart by a center-to-center distance of about 0.045 inches.

While the invention is illustrated with reference to a rotary switch device, it will be recognized that the invention can be applied to non-rotary devices, such as a linear motion encoders, and to devices having different detent counts from those illustrated.

Similarly, while the invention is illustrated with reference to a single detent engaging ball, the spring may, for example, be modified to include two or more balls. Also, the spring may be further modified so that the force applied to the ball has an outward radial component instead of the illustrated inwardly directed force.

Furthermore, while the invention is illustrated in the context of an optoelectronic digital motion encoder, it may be used in other devices such as standard contact switches and potentiometers.

In view of the many possible embodiments to which the principles of my invention may be put, it should be recognized that the detailed embodiment is illustrative only and should, not be taken as limiting the scope of the invention. Rather, I claim as my invention all such embodiments as may come within the scope and spirit of the following claims and equivalents thereto.

I claim:

1. An apparatus for providing tactile feedback during a useful life, the apparatus comprising:

a plate having a surface and a ball path on the surface, the surface having one or more indentations along the ball path and adjacent separation surfaces along the ball path adjacent to the one or more indentations;

each indentation having a pair of side walls that are approximately perpendicular to the ball path and approximately vertical and each indentation having a pair of end walls connected to the pair of side walls; the pair of side walls being spaced a width apart and defining a pair of shoulders transitioned into the adjacent separation surfaces, the pair of end walls being spaced a length apart, the length being larger than the width, and each indentation also having a floor that is located at a depth below the adjacent separation surfaces;

a ball positioned against the surface of the plate on the ball path, the ball having a diameter that is greater than the indentation width;

a spring in contact with the ball, the spring engaging and exerting an urging force pushing the ball against the surface of the plate;

tactile means, coupled to the plate, for causing relative motion between the plate and the ball so that the ball travels along the ball path; and such that, during the useful life, the ball is supported by the shoulders of each indentation, the ball avoids being supported by the pair of end walls, and the ball avoids touching the floor of each indentation so that the apparatus thereby continues to exhibit tactile feedback.

2. The apparatus of claim 1, wherein the indentation width is between 0.42 and 0.55 times the ball diameter.

3. The apparatus of claim 1, wherein the floor of each indentation is located below the adjacent separation surfaces at a depth of at least 0.5 times the diameter of the ball.

4. The apparatus of claim 3, wherein the indentation width is between 0.42 and 0.55 times the ball diameter.

5. The apparatus of claim 4, wherein the indentation length is at least 0.5 times the diameter of the ball.

6. The apparatus of claim 5, wherein the spring defines a ball engaging hole and the diameter of the ball is between 1.04 and 1.16 times the diameter of the ball engaging hole.

7. The apparatus of claim 6, wherein the urging force exerted by the spring has a first component perpendicular to the surface of the plate and a second component in the direction parallel to the side walls of each indentation, whereby the second component pushes the ball gradually in the direction perpendicular to the side walls of each indentation and the useful life is extended.

8. The apparatus of claim 7, wherein the spring comprises a leaf spring that is pre-bent at a bend angle.

9. The apparatus of claim 8, wherein the bend angle is between 10 and 45 degrees.

10. The apparatus of claim 8, wherein the spring is a ½ hard sheet of beryllium copper with a thickness of between 0.005 and 0.020 inches, and a distance between the bend and the center of the ball engaging hole of between 0.0150 and 0.20 inches, whereby the ball engages the indentation with sufficient force to prevent the ball from moving relative to the plate except by deliberate manual rotation.

11. The apparatus of claim 1, wherein the plate moves linearly with respect to the ball, the ball path is linear, and the side walls of the one or more indentations are approximately parallel to each other.

12. The apparatus of claim 11, wherein the floor of each indentation is located below the adjacent separation surfaces at a depth of at least 0.5 times the diameter of the ball.

13. The apparatus of claim 12, wherein the indentation width is between 0.42 and 0.55 times the ball diameter.

14. The apparatus of claim 13, wherein the indentation length is at least 0.5 times the diameter of the ball.

15. The apparatus of claim 14, wherein the spring defines a ball engaging hole and the diameter of the ball is between 1.04 and 1.16 times the diameter of the ball engaging hole.

16. The apparatus of claim 2, wherein the floor of each indentation is located below the adjacent separation surfaces at a depth that is approximately equal to the length of the indentation and is at least 0.5 times the diameter of the ball.

17. The apparatus of claim 1, wherein the plate rotates on an axis with respect to the ball and the ball path is approximately circular.

18. The apparatus of claim 17, wherein the urging force exerted by the spring has a first component perpendicular to the surface of the plate and a second component in a direction parallel to the side walls of each indentation, whereby the second component pushes the ball gradually in the direction parallel to the side walls of each indentation and the useful life is extended.

19. The apparatus of claim 18, wherein the indentation width is between 0.42 and 0.55 times the ball diameter.

20. The apparatus of claim 19, wherein the floor of each indentation is located below the adjacent separation surfaces at a depth that is approximately equal to the length of the indentation and that is at least 0.5 times the diameter of the ball.

* * * * *